United States Patent [19]

Engstrom

[11] 4,166,318

[45] Sep. 4, 1979

[54] TRUCK-TRAILER CALCULATOR

[76] Inventor: Donald G. Engstrom, 2846 S. 163rd Plz., Omaha, Nebr. 68130

[21] Appl. No.: 915,973

[22] Filed: Jun. 16, 1978

[51] Int. Cl.[2] ..... G06G 7/48

[52] U.S. Cl. ..... 33/1 G; 33/1 SD; 35/7 R; 116/28 R

[58] Field of Search ..... 33/1 SD, 1 SB, 1 G, 33/1 R, 103, 76, 76 VA, 174 G, 174 B, 161, 107; 73/432 SD; 116/28 R; 35/7 R, 7 A, 16; 235/89 R; 40/19.5, 375

[56] References Cited

U.S. PATENT DOCUMENTS

| | | | |
|---|---|---|---|
| 882,749 | 3/1908 | Dumonceau | 33/5 |
| 1,360,726 | 11/1920 | Crook | 235/89 R |
| 1,837,743 | 12/1931 | Wilson et al. | 35/28 |
| 2,230,954 | 2/1941 | Jakosky | 33/1 SD |
| 3,135,464 | 6/1964 | Quesenberry | 33/161 |
| 3,625,417 | 12/1971 | Slanter | 33/76 VA |

*Primary Examiner*—John W. Shepperd

*Attorney, Agent, or Firm*—Zarley, McKee, Thomte, Voorhees & Sease

[57] ABSTRACT

A tractor-trailer calculator includes several tractor-trailer indicia portions slidably supported on an elongated support structure at positions to simulate a tractor-trailer vehicle. The indicia portions include a tractor cab portion, a tractor tandem axle portion, a tractor fifth wheel and trailer king pin portion, front and rear trailer portions and a trailer tandem axle portion. Each portion is slidably supported on the support structure in overlapping relation to at least one adjacent portion whereby the overall length of the simulated vehicle and the relative positions of the overlapping portions may be varied to conform to predetermined length requirements for a tractor-trailer vehicle. Measurement devices are associated with the pairs of overlapping indicia portions to indicate their relative positions. Another measurement device is adjustably and slidably supported on the support structure adjacent the indicia portions for measuring various lengths of the simulated tractor-trailer vehicle.

18 Claims, 7 Drawing Figures

TRUCK-TRAILER CALCULATOR

BACKGROUND OF THE INVENTION

This invention relates in general to measurement devices and more particularly to a special purpose calculator in the form of a simulated tractor-trailer vehicle having variable length components for adjusting the tractor wheel base, tractor fifth wheel and trailer king pin settings, trailer length and trailer tandem location to determine that combination of lengths which will meet statutory truck length requirements or the requirements for a particular load.

A particular problem for the purchasers and operators of tractor-trailer vehicles is that the state laws now in effect for governing the length of tractor semi-trailer combinations and weights per axle or per combination of axles on such equipment are inconsistent between the various states of the United States of America. In addition, there are federal laws now in effect for governing the various weight and length combinations for tractor semi-trailers on interstate highways.

In the past, it has been necessary for the purchaser or operator of a tractor-trailer vehicle to perform cumbersome trial and error mathematical calculations to determine optimum lengths for a tractor-trailer vehicle to meet the various statutory requirements. Such calculations required writing paraphernalia and were subject to error especially when performed hastily.

A particular problem with such calculations is to determine the accumulated effect of various tractor-trailer adjustments on the overall vehicle length. For example, the trailer length may be increased by one foot and the trailer king pin location moved rearwardly one foot with no change in the overall vehicle length. It is the difficulty of visualizing and coordinating the various tractor-trailer adjustments which is a constant problem for the owners and operators of tractor-trailer vehicles, particularly those engaged in interstate transportation.

SUMMARY OF THE INVENTION

The truck-trailer calculator of the present invention can quickly and easily provide a positive visual indication of the proper combinations of tractor and trailer adjustments required to conform to present laws now in effect governing the length of tractor semi-trailer combinations and weights per axle or combination of axles on loaded equipment. The tractor-trailer indicia portions are slidably supported on the support structure in overlapping relation so that the lengths of the various tractor-trailer components may be readily adjusted. The measurement indicators associated with the overlapping indicia portions enable precise adjustment and readout of the various tractor-trailer settings at selected relative positions of the indicia portions. The extensible and collapsible rulers situated on the support structure directly below the simulated vehicle provide a ready indication of the overall vehicle length and/or interior bridge length associated with any particular combination of tractor-trailer settings.

Accordingly, use of the truck-trailer calculator of the present invention eliminates the need for manual mathematical calculations in the determination of proper tractor-trailer vehicle length adjustments. The calculator is a very efficient and effective tool for use by anyone in the trucking industry concerned with weight and length laws. Both sales personnel and truck purchasers may use the calculator to easily predetermine proper specifications for truck tractor-trailer equipment prior to purchasing. Tractor-trailer operators will find use of the present calculator to be most advantageus for determining the necessary modifications of dimensions needed when a tractor-trailer vehicle moves from one state to another.

DESCRIPTION OF THE PREFERRED EMBDIMENT

Figure 1:
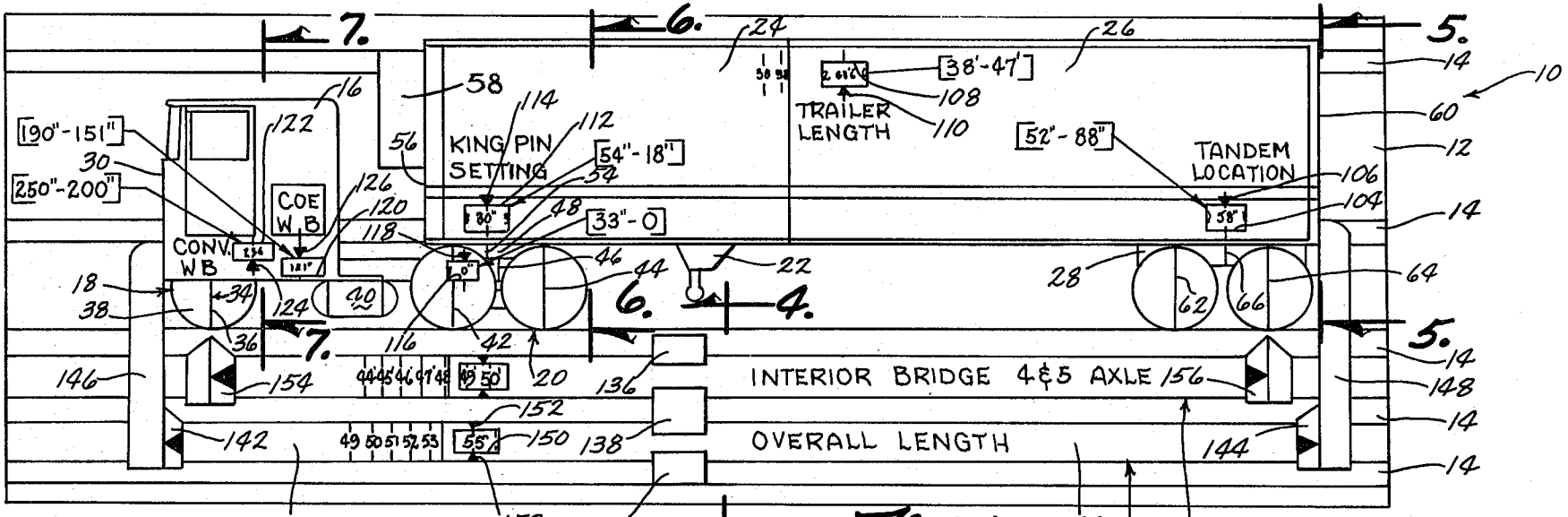
FIG. 1 is a side elevational view of the truck-trailer calculator of the invention.

The tractor-trailer calculator of the present invention, indicated generally at 10 in FIG. 1, includes a plurality of tractor-trailer indicia portions slidably supported on an elongated support structure 12 having several elongated tracks 14 arranged in parallel vertically spaced apart relation.

Figure 2:
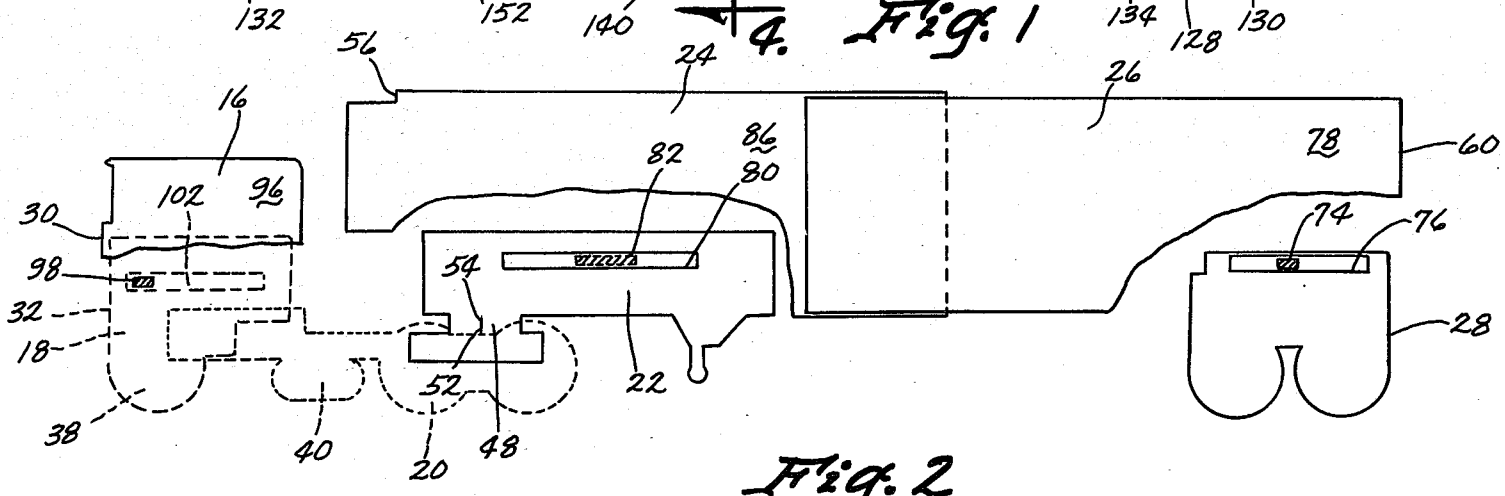
FIG. 2 is a side elevational view of the tractor-trailer indicia portions in the positions shown in FIG. 1, with portions broken away and outlined in dotted line form to show the relative overlapped positions thereof.

Referring to FIG. 2, it can be seen that the tractor-trailer indicia portions include a tractor cab portion 16, having a hood portion 18 extensible and retractable relative thereto, a tractor tandem axle portion 20, a combined tractor fifth wheel and trailer king pin portion 22, a front trailer portion 24, a rear trailer portion 26 and a trailer tandem axle portion 28. Each portion is supported for longitudinal sliding movement on the support structure 12 in overlapping relation to at least one adjacent portion such that both the relative positions between adjacent overlapping portions and the overall length of the combined portions may be varied to conform to predetermined length requirements for a tractor-trailer vehicle.

Figure 3:
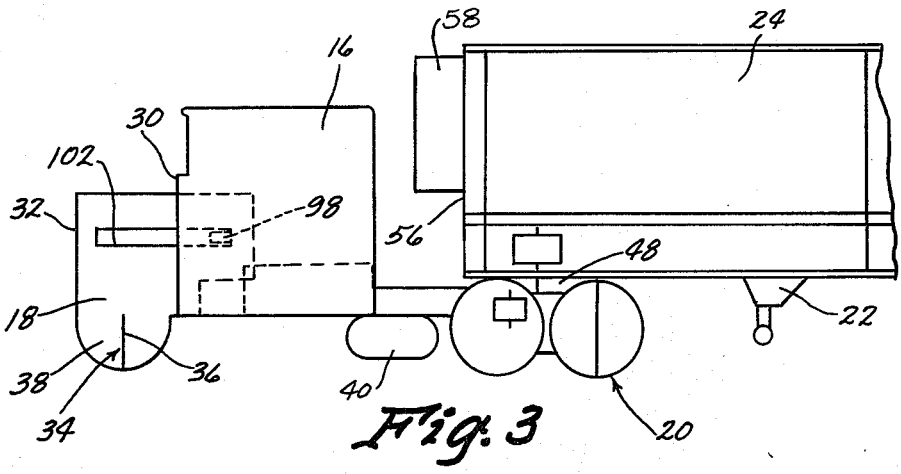
FIG. 3 is a foreshortened side elevational view of the tractor-trailer indicia portions showing the hood portion exended forwardly from the tractor cab portion to simulate a conventional tractor.

The tractor-trailer indicia portions have coordinated peripheral shapes adapted to simulate a tractor-trailer vehicle when the portions are assembled onto the tracks 14 of the support structure 12 as shown in FIG. 1. Accordingly, the tractor cab portion 16 has a forward edge 30 corresponding to the forward extent of a cab-over-engine tractor. Hood portion 18 has a forward edge 32 adapted to correspond to the forward extent of a conventional tractor when the hood portion is extended forwardly of the cab portion as shown in FIG. 3. The hood portion 18 also has a steering axle indicator 34 represented by a vertical line 36 on an arcuate downward projection 38 representing the front steering wheel of a tractor. Similarly, the tractor tandem axle portion 20 has a depending fuel tank indicator 40 and a pair of longitudinally spaced apart vertical lines 42 and 44 representing the center lines of the forward and rearward tandem axles respectively. Centered between lines 42 and 44 is a tractor tandem axle indicator line 46 representing the longitudinal center of the tractor tandem axles.

On the traler, the king pin portion 22 includes a depending tractor fifth wheel portion 48 and a pair of vertically aligned indicator lines 52 and 54 representing the longitudinal centers of the tractor fifth wheel and trailer king pin respectively. The fifth wheel and king pin indicator lines 52 and 54 are thus fixed relative to one another on the same indicia portion 22 for longitudinal movement in unison.

The front trailer portion 24 has a forward edge 56 and a compressor compartment indicator 58 extended forwardly therefrom. The rear trailer portion 26, also of substantially reactangular shape, has a rearward edge 60. The trailer tandem axle portion 28 has a pair of vertical lines 62 and 64 indicating the longitudinal centers of the front and rear trailer tandem axles and a tandem axle indicator line 66 longitudinally centered between lines 62 and 64.

Figure 5:
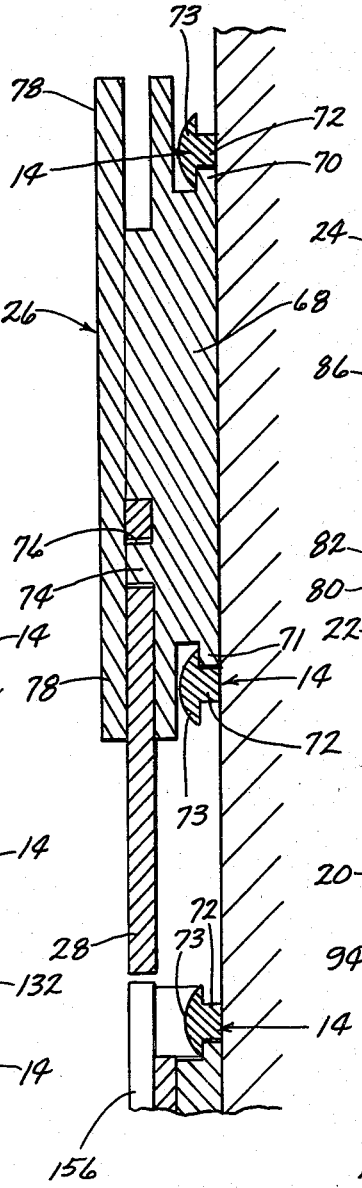
FIG. 5 is a rear sectional view taken along line 5—5 in FIG. 1 showing the assembly of the trailer and trailer tandem axle portions.

Assembly of the tractor-trailer indicia portions 16–28 onto the support structure 12 can be seen with reference to FIGS. 2 and 5–7. Referring to FIG. 5, the rear trailer portion 26 is shown as including a base member 68 having oppositely extended vertical flanges 70 and 71 for slidably retaining the base member between a pair of adjacent tracks 14. Each of the tracks 14 includes an elongated web 72 fixed to the support structure 12 and an elongated head portion 73 vertically extended from the web portion 72 in opposite directions to form upper and lower channels for slidably receiving the flanges of the various tractor-trailer indicia portions.

A slide plug 74 (FIGS. 2 and 5) extends outwardly from the base member 68 for slidably supporting the trailer tandem axle portion 28 thereon. The trailer tandem axle portion 28 has a longitudinally extended slot 76 formed therein which is adapted to receive the slide plug 74 and permit longitudinal sliding movement of the trailer tandem axle portion 28 relative to the rear trailer portion 26. Finally, the rear trailer portion 26 is provided with an outer member 78 secured to the base member at a position outwardly to the slide plug 74. The outer member 78 extends in opposite vertical directions from the slide plug to retain the tandem axle portion 28 between the base member 68 and outer member 78. It is the outer member 78 which presents the appearance of the rear half of the trailer in FIG. 1.

Figure 6:
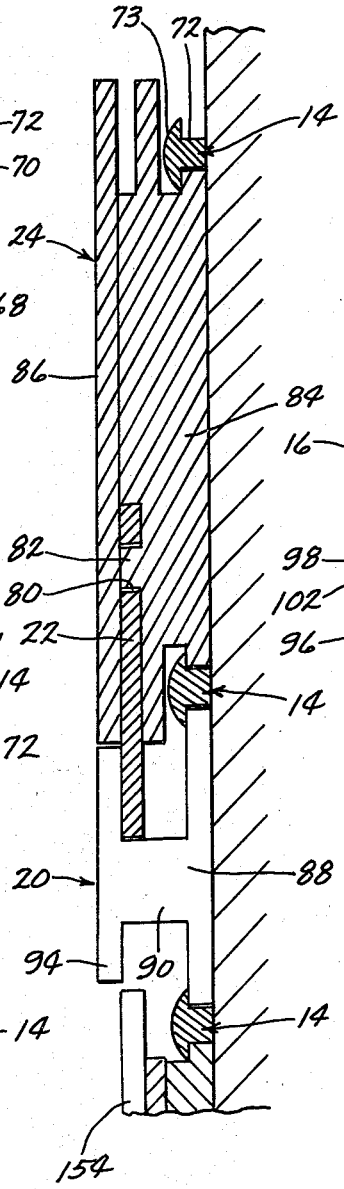
FIG. 6 is a rear sectional view taken along line 6—6 in FIG. 1 showing the assembled relation of the trailer portion, trailer king pin portion ad tractor tandem axle portion.

Referring to FIGS. 2 and 6, it can be seen that the fifth wheel and trailer king pin portion 22 is also provided with a longitudinal slot 80 for slidable support on a slide plug 82 sandwiched between base and outer members 84 and 86 of the front trailer portion 24.

Figure 7:
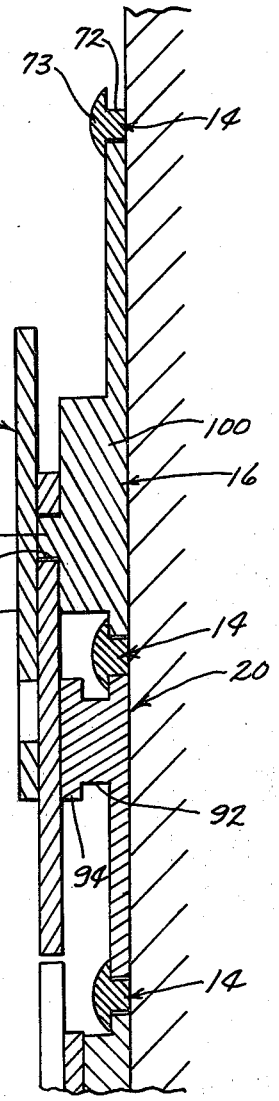
FIG. 7 is a rear sectional view taken along line 7—7 in FIG. 1 showing the assembled relation of the tractor cab portion, hood portion and tractor tandem axle portion.

The tractor tandem axle portion 20 is shown in FIGS. 2, 6 and 7 as having a variable H-shape in cross section including a base portion 88 slidably retained between an adjacent lower pair of tracks 14. Extended outwardly from base portion 88 are a pair of projections 90 and 92 which support an outer portion 94 which displays the fuel tank indicator 40 and indicator lines 42, 44 and 46 in the view of FIG. 1.

In FIG. 7, it is seen that the outer portion 94 of the tractor tandem axle portion 20 is substantially hidden behind the outer member 96 of tractor cab portion 16. Outer member 96 cooperates with slide plug 98 and base member 100 of the tractor cab portion 16 to slidably support the hood portion 18 having longitudinal slot 102 in the manner previously described in connection with portions 28 and 22.

There is associated with each pair of overlapping indicia portions 16–28 a device for measuring the position of each portion relative to the portion associated with it in overlapping relation. For example, there is shown in FIG. 1 an opening 104 through the outer member 78 of the rear trailer portion 26 which exposes scaled length calibrations printed on the underlying trailer tandem axle portion 28. The calibrations indicate a range of 52 inches to 88 inches. An indicator arrow 106 is positioned adjacent opening 104 at a position for registration with the calibrations to indicate the trailer tandem setting, the distance between the tandem axle indicator line 66 and the rearward edge 60 of the rear trailer portion 26.

Trailer length is similarly indicated by an opening 108 in the rear trailer portion 26 which exposes scaled length calibrations on the front trailer portion 24 ranging from 38 feet to 47 feet. An indicator arrow 110 registers with the calibrations for indicating the trailer length, the distance between the forward edge 56 and rearward edge 60 of trailer portions 24 and 26 respectively.

The adjusted position of the trailer king pin is visible through an opening 112 in the front trailer portion 24 which exposes scaled length calibrations on the king pin portion 22 ranging from 54 inches to 18 inches. An indicator arrow 114 registers with the calibrations to indicate the king pin setting, the longitudinal distance between the trailer forward edge 56 and the king pin indicator line 54.

The tractor fifth wheel adjustment can be viewed through an opening 116 through the tractor tandem axle portion 20 which exposes scaled length calibrations on the fifth wheel and king pin portion 22 ranging from 33 inches to zero inches. An arrow 118 registers with the calibrations to indicate the tractor fifth wheel setting, the longitudinal distance between the fifth wheel indicator line 52 and the tractor tandem axle indicator line 46.

Finally, the tractor wheel base setting is alternately viewable through openings 120 or 122 depending on whether the hood portion 18 is extended to simulate a conventional tractor or retracted to simulate a cab-over-engine tractor. When the hood portion 18 is extended, opening 122 exposes scaled length calibrations on the tractor tandem axle portion ranging from 250 inches to 200 inches. An arrow 124 registers with the calibrations to indicate the tractor wheel base, the longitudinal distance between the steering axle indicator line 36 and tractor tandem axle indicator line 46. When the hood portion 18 is retracted, it covers the calibrations otherwise viewable through opening 122. Opening 120 however exposes another set of scaled length calibrations on the tractor tandem axle portion 20 ranging from 190 inches to 151 inches. An arrow 126 registers with these calibrations to indicate the wheel base of the cab-over-engine tractor.

Figure 4:
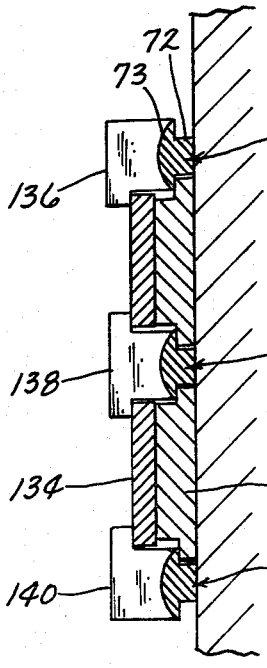
FIG. 4 is a rear sectional view taken along line 4—4 in FIG. 1 showing the extensible and collapsible rulers for measuring vehicle lengths.

A pair of extensible and retractable rulers 128 and 130 are slidably supported on the support structure 12 directly below the tractor indicia portions 16–28 for the purpose of measuring the overall vehicle length and interior bridge length respectively corresponding to any particular combination of tractor-trailer settings. In FIGS. 1 and 4, it is seen that ruler 128 includes an underlying portion 132 slidably retained between a pair of tracks 14 and an overlying portion 134 slidably retained between a lower pair of three guide blocks 136, 138 and 140 which are respectively fixed on three adjacent tracks 14. The rearward end of overlying portion 134 is secured to a short base member (not shown) slidably retained between tracks 14. Both the underlying portion 132 and overlying portion 134 are provided with respective reference markers 142 and 144 which include respective vertically extended arms 146 and 148 adapted for engagement with the forward edge 30 of the tractor cab and rearward edge 60 of the trailer respectively. The overall length of the vehicle, which is the distance between arms 146 and 148, is viewable through an opening 150 in the overlying portion 134 which exposes scaled length calibrations on the underlying portion 132 ranging from 49 feet to 85 feet. Indicator arrows 152 adjacent openings 150 register with the calibrations to indicate the overall length of the tractor-trailer vehicle.

The second extensible and collapsible ruler 130 is similarly constructed for indicating the distance between reference markers 154 and 156 which may be vertically aligned with the front and rear axles of the vehicle to indicate the interior bridge length for the tractor-trailer vehicle.

In operation, one can quickly determine the overall length of a particular vehicle by adjusting the tractor-trailer indicia portions to correspond to the tractor wheel base, fifth wheel setting, trailer length, trailer king pin setting and trailer tandem axle setting for the vehicle to be measured. By engaging the vertical arms 146 and 148 against the forward and rearward edges of the vehicle, the overall length is readily viewable on ruler 128. Certain of the tractor and trailer settings may be adjustable if the tractor is provided with a sliding fifth wheel or the trailer includes an adjustable king pin and/or adjustable tandem axle assembly. The operator of such a vehicle may vary one or more of the adjustable settings on the truck-trailer calculator to determine the extent of adjustments which may be permissible or required upon entering a state having different weight and length laws than the state previously traveled through.

Thus there has been shown and described a truck-trailer calculator which may be used to quickly and easily visually indicate the length of any tractor-trailer vehicle as well as the effect on overall length of adjustments to any of the various tractor-trailer settings.

I claim:

1. A tractor trailer calculator comprising an elongated support structure, a plurality of tractor trailer indicia portions, meas for longitudinally slidably supporting said tractor trailer indicia portions on said support structure at relative positions so as to simulate a tractor trailer vehicle, said indicia portions including a tractor cap portion, a tractor tandem axle portion, front and rear trailer portions, a trailer king pin portion and a trailer tandem axle portion, said means for slidably supporting said portions on said support structure being adapted to support each portion in overlapping relation to at least one adjacent portion whereby the overall length of said combined portions and relative positions between said overlapping portions may be varied to conform to predetermined length requirements for a tractor trailer vehicle, and measuring means operatively associated with said indicia portions for measuring the overall length of said combined portions and relative positions between said overlapping portions.

2. The structure of claim 1 wherein said tractor cab portion includes a hood portion longitudinally slidably supported thereon for movement between an extended position forwardly of said cab portion and a retracted position substantially overlapped with said cab portion for simulating conventional and cab-over-engine tractor vehicles respectively.

3. The structure of claim 2 wherein said measuring means includes scaled length calibrations on one of said overlapping portions, and indicator means positioned on the other overlapping portion at a position for registration with said calibrations to indicate the relative position of said one portion relative to the other.

4. The structure of claim 1 wherein one of the said overlapping adjacent indicia portions includes a base member longitudinally slidably supported on said support structure, a slide plug extended outwardly from said base member and an outer member secured outwardly of said slide plug and extended in opposite vertical directions therefrom, another of said overlapping adjacent indicia portions including a longitudinally extended slot therethrough, said other indicia portion being slidably supported between said base member and outer member with said slide plug received within said slot.

5. The structure of claim 4 wherein said support structure includes a plurality of vertically spaced apart elongated tracks and said base member is longitudinally slidably supported between a pair of adjacent tracks.

6. The structure of claim 1 including means slidably supported on said support structure for measuring various lengths of said combined portions.

7. The structure of claim 6 wherein said measuring means includes an extensible and collapsible ruler having an underlying portion and an overlying portion longitudinally slidably supported on said support structure, each portion having a reference marker, one portion having scaled length calibrations thereon and the other portion having an indicator positioned thereon for registration with said calibrations to indicate the distance between said reference markers.

8. A calculator for determining lengths of tractor trailer vehicles comprising, a support means, tractor and trailer elements, means for mounting said tractor and trailer elements on said support means for sliding movement of at least one of said elements relative to the other, means on said tractor and trailer elements for measuring the relative positions of said tractor and trailer elements, and means on said support means for measuring the overall length of said tractor and trailer elements.

9. A tractor trailer calculator comprising a support means, elongated track means on said support means, said track means including a plurality of longitudinally extended and vertically spaced apart tracks, tractor and trailer elements mounted on said tracks for sliding movement of at least one element relative to the other, said tractor element including a steering axle indicator, a tandem axle indicator and a fifth wheel indicator, said indicators being supported on said tracks for adjustable longitudinal movement relative to one another, and said trailer element including forward and rearward portions, a king pin indicator adapted for vertical alignment with said fifth wheel indicator and a tandem axle indicator positioned rearwardly of said king pin indicator, said portions and indicators of said trailer element being operatively supported on said tracks for adjustable longitudinal movement relative to one another, and measuring means operatively associated with said portions and indicators for longitudinally measuring said elements at various relativel positions therefor.

10. The structure of claim 9 wherein said fifth wheel indicator of said tractor element and king pin indicator of said trailer element are fixed relative to one another for longitudinal movement in unison.

11. The structure of claim 9 further comprising wherein said measuring means comprises extensible and retractable measuring means slidably mounted on said tracks and including first and second reference markers alignable with opposite ends of said tractor and trailer elements and means for measuring the distance between said reference markers.

12. The structure of claim 11 wherein said reference markers comprise vertically extended arms slidably movable on said tracks into engagement with said opposite ends of the tractor and trailer elements.

13. The structure of claim 12 further comprising second extensible and retractable measuring means having third and fourth reference markers adapted for alignment with said steering axle indicator and tandem axle indicator of said trailer element respectively and means for measuring the longitudinal distance between said third and fourth reference markers.

14. The structure of claim 9 wherein said measuring means comprises means associated with said tractor element for measuring the longitudinal distance between said steering axle indicator and tandem axle indicator of the tractor element.

15. The structure of claim 7 wherein said measuring means comprises means associated with said tractor element for measuring the longitudinal displacement of said fifth wheel indicator relative to said tandem axle indicator of said tractor element.

16. The structure of claim 9 wherein said measuring means comprises means associated with said trailer element for measuring the length of the combined forward and rearward portions.

17. The structure of claim 9 wherein said measuring means comprises means associated with said trailer element for measuring the longitudinal displacement of said king pin indicator relative to said forward edge of said forward portion.

18. The structure of claim 9 wherein said measuring means comprises means associated with said trailer element for measuring the longitudinal displacement of said tandem axle indicator of the trailer element relative to the rearward edge of said rearward portion.

* * * * *